United States Patent [19]

Kakumoto et al.

[11] 4,426,776

[45] Jan. 24, 1984

[54] ELECTRIC SHAVER

[75] Inventors: Hiromi Kakumoto; Shinji Ihara; Yoji Iguchi; Makoto Miyata, all of Hikone, Japan

[73] Assignee: Matsushita Electric Works, Ltd., Osaka, Japan

[21] Appl. No.: 384,888

[22] Filed: Jun. 4, 1982

[30] Foreign Application Priority Data

Jun. 15, 1981 [JP] Japan ..... 56-92734

[51] Int. Cl.[3] ..... B26B 19/10

[52] U.S. Cl. ..... 30/34.1; 30/41

[58] Field of Search ..... 30/34.1, 41, 41.5

[56] References Cited

U.S. PATENT DOCUMENTS

| | | | |
|---|---|---|---|
| 2,601,720 | 7/1952 | Carissimi | 30/43 |
| 3,369,294 | 2/1968 | Shaw | 30/41.5 |
| 3,772,779 | 11/1973 | Douglass et al. | 30/42 |
| 3,793,723 | 2/1974 | Kuris et al. | 30/45 |
| 3,950,847 | 4/1976 | Duda | 30/34.1 |
| 4,274,199 | 6/1981 | Gallanis | 30/34.1 |
| 4,363,169 | 12/1982 | Nasu et al. | 30/41 |

FOREIGN PATENT DOCUMENTS

| | | |
|---|---|---|
| 2137378 | 2/1974 | Fed. Rep. of Germany . |

*Primary Examiner*—Jimmy C. Peters

*Attorney, Agent, or Firm*—Stevens, Davis, Miller & Mosher

[57] ABSTRACT

An electric shaver with a trimmer is disclosed in which a single flexible seal is used to protect the motor and electric parts from water and other material entering through the perforated comb or the trimmer.

16 Claims, 12 Drawing Figures

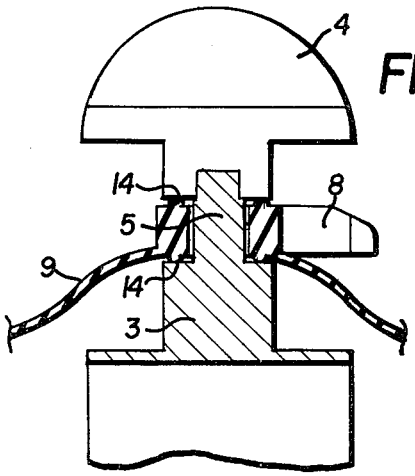
FIG. 5
FIG. 6
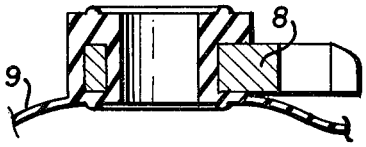
FIG. 7
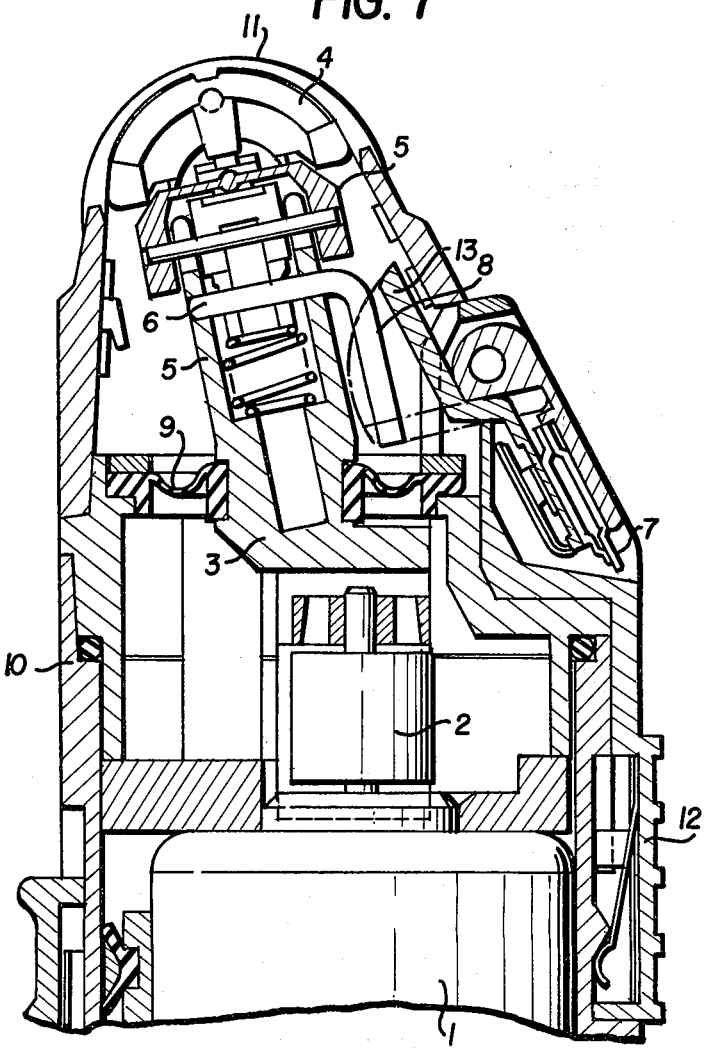

ELECTRIC SHAVER

BACKGROUND OF THE INVENTION

This invention relates to electric dry shavers having a trimmer. Such electric shavers are known in the art and have several advantages over safety razors, which are used with soap and water applied to the user's skin and thus are often known as wet shavers. However, electric shavers are inferior to wet razors in that they leave the user with a less refreshing feeling after shaving and in that they require cleaning to remove dust, whisker fragments and the like. Thus, electric shavers are sometimes washed in water to remove dust, whisker fragments and the like or used while bathing with soap and water. This can have a deleterious effect on a conventional electric shaver since, although its motor and electrical parts are protected from water entering through the perforated shaving comb, they are not protected from water entering through the trimmer. Thus, water may reach the motor and electrical parts in such conventional electric shavers causing a short circuit or malfunction of the motor or other electrical parts or otherwise resulting in damage and decreasing the useful life of the shaver. Also, whisker fragments and the like may also reach the motor or electric parts through the trimmer and also cause damage.

SUMMARY OF THE INVENTION

It is an object of the claimed invention to provide an electric shaver with a trimmer having a sealing means which protects the motor and electrical parts from water, dust, whisker fragments and the like which enter the electric shaver through its perforated comb and its trimmer. It is a further object of the claimed invention to provide such an electric shaver which has few parts, is less expensive and less complicated to produce, and is more reliable than conventional electric shavers with trimmers. These and other objects are attained in the claimed invention by an electric shaver having a novel sealing means which employs a single seal to seal its motor and electrical parts from water, dust, whisker fragments and the like entering from both its perforated comb and its trimmer.

BRIEF DESCRIPTION OF THE DRAWINGS

FIG. 5 is a semi-schematic detail, in cross-section, of the sealing means of a fourth embodiment of the electric shaver of the claimed invention;

FIG. 6 is a semi-schematic detail, in cross-section, of the sealing means of a fifth embodiment of the electric shaver of the claimed invention;

FIG. 7 is a partial side view, in cross-section, of a sixth embodiment of the electric shaver of the claimed invention;

DETAILED DESCRIPTION OF THE INVENTION

Figure 1:
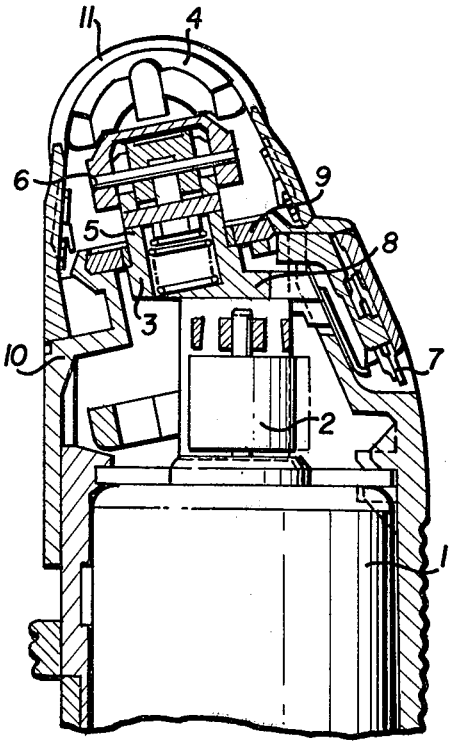
FIG. 1 is a partial side view, in cross-section, of a conventional electric shaver.

Referring now to FIG. 1, this shows a conventional electric shaver with a trimmer. In this conventional electric shaver, a set of parallel cutting blades 4 is mounted on a cutter blade platform which is driven in reciprocating motion beneath perforated comb 11. The reciprocating motion is perpendicular to the flat of blades 4, i.e., perpendicular to the plane of FIG. 1. The driving force for this reciprocating motion is provided by motor 1 through an eccentric cam 2 which is attached to the rotating shaft of motor 1. The resultant reciprocating motion generated by eccentric cam 2 is transmitted to drive element 3 by reciprocation conversion means well known to the art. Cutting blades 4 are detachably connected to drive element 3 by detachably mounting their cutter blade platform to the upper portion 5 of drive element 3 by a connecting pin. Casing 10 surrounds motor 1 and eccentric cam 2 as well as the lower portion of drive element 3. A sealing plate 9 is disposed between drive element 3 and casing 10 and has a central opening through which drive element 3 projects. Sealing plate 9 acts to seal motor 1, eccentric cam 2 and the lower portion of drive element 3 from perforated comb 11, cutting blades 4 and the upper portion 5 of drive element 3. The electric shaver is provided with a trimmer 7 which may be rotated upward and outward for use. When trimmer 7 is so rotated, a trimmer drive stem extending from the end of trimmer 7 opposite to that of the trimming blades engages a trimmer drive lever 8 which projects from the lower portion of drive element 3. The trimmer drive lever 8 shares in the reciprocating motion of drive element 3 when the electric shaver is in operation. Thus when trimmer drive lever 8 and the trimmer drive stem engage, the reciprocating motion of trimmer drive lever 8 is transmitted to trimmer 7 to drive the trimming blades thereof.

As mentioned, such conventional electric shavers have several advantages over safety razors, which are used with soap and water applied to the user's skin and thus are often known as wet razors. However, such electric shavers are inferior to wet razors in that they leave the user with a less refreshing feeling after shaving and in that they require cleaning to remove dust, whisker fragments and the like. Thus, electric shavers are sometimes washed in water to remove whisker fragments or used while bathing with soap and water. This can have a deleterious effect on the electric shaver since, although its motor 1 and electrical parts are protected from water entering through perforated shaving comb 11 by sealing plate 9, they are not protected from water entering through trimmer 7 which is located beneath sealing plate 9. Thus, water may reach motor 1 and electrical parts beneath sealing plate 9 causing a short circuit or malfunction of motor 1 or these electrical parts or otherwise resulting in damage and decreasing the useful life of the shaver. Also, whisker fragments, dust and the like may also reach motor 1 or electric parts through trimmer 7 and cause damage.

Figure 2:
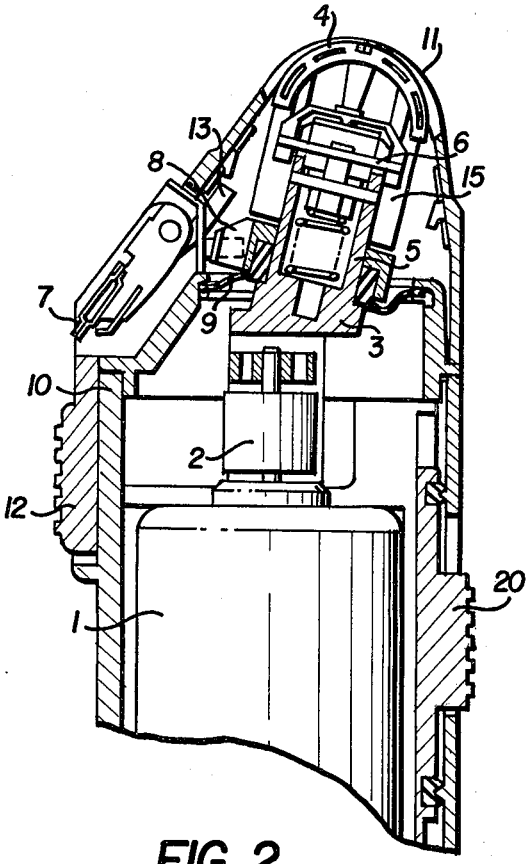
FIG. 2 is a partial side view, in cross-section, of a first embodiment of the electric shaver of the claimed invention.

FIG. 2 shows a first embodiment of the electric shaver of the claimed invention. In this embodiment, a set of parallel cutting blades 4 is mounted on a cutter blade platform which is driven in reciprocating motion beneath perforated comb 11. The reciprocating motion is perpendicular to the flat of blades 4, i.e., perpendicular to the plane of FIG. 2. The driving force for this reciprocating motion is provided by motor 1 through an eccentric cam 2 which is attached to the rotating shaft of motor 1. The resultant reciprocating motion generated by eccentric cam 2 is transmitted to drive element 3 by reciprocation conversion means well known to the art. Cutting blades 4 are detachably connected to drive element 3 by detachably mounting their cutter blade platform at the upper portion 5 of drive element 3 by connecting pin 6. Casing 10 surrounds motor 1 and eccentric cam 2. A support piece is mounted on the shaving head end of casing 10 and a shaving head enclosure (which includes perforated comb 11) is mounted on the support piece. A trimmer 7 is mounted on a trimmer mounting base which is disposed between the support piece and the shaving head enclosure. Trimming blades are located at one end of trimmer 7 and may be rotated upward and outward for use by rotation of the trimmer 7 about a pivot at the other end of trimmer 7 which is fixed to the trimmer mounting base. Trimmer handle 12 is slidably mounted on casing 10, and engages trimmer 7 between its pivot and its trimmer blade end. Pivoting of trimmer 7 may be accomplished by moving trimmer handle 12 upward. Trimmer 7 is provided with a trimmer drive stem 13 extending from its pivot end. When trimmer 7 is rotated upward and outward by trimmer handle 12, trimmer drive stem 13 engages trimmer drive lever 8 which extends from a drive lever ring which is mounted around the upper portion 5 of drive element 3. The drive lever ring shares in the reciprocating motion of drive element 3. When trimmer drive stem 13 and trimmer drive lever 8 are engaged, the trimmer blades will also share in the reciprocating motion of drive element 3. A flexible sealing plate 9 is disposed below the drive lever ring between the mounting piece and drive element 3 and has a central opening through which drive element 3 projects. Sealing plate 9 has an inner bead portion around its central opening which engages drive element 3 and shares in its reciprocating motion. The inner bead of plate 9 also engages the lower portion of the driver lever ring. The drive lever ring may have a skirt extending downwardly from its periphery within which the inner bead of plate 9 may be engaged. Sealing plate 9 also has an outer bead along its outer edge which engages the support piece mounted on casing 10. With its inner and outer beads so engaged, sealing plate 9 will seal motor 1 and eccentric cam 2 from dust, whisker fragments, water, soap and the like which enter through perforated comb 11 or trimmer 7. Furthermore, providing a single sealing plate 9 reduces the number of parts which would otherwise be required to effect such sealing and reduces manufacturing costs.

Figure 3:
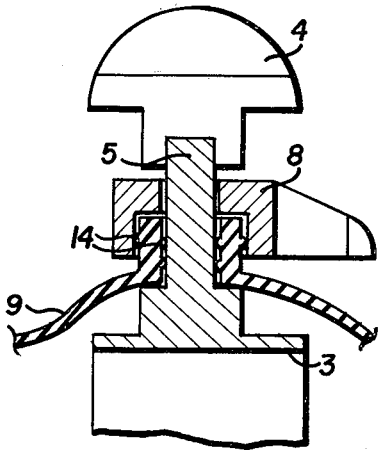
FIG. 3 is a semi-schematic detail, in cross-section, of the sealing means of a second embodiment of the electric shaver of the claimed invention.
Figure 4:
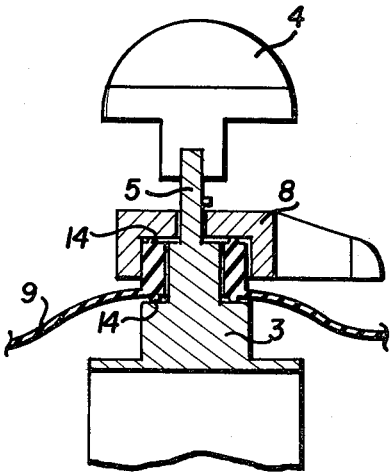
FIG. 4 is a semi-schematic detail, in cross-section, of the sealing means of a third embodiment of the electric shaver of the claimed invention.

As shown in FIG. 3, to further improve the sealing effect of sealing plate 9, semi-circular sealing rings 14 of the O-ring type may be disposed around the inner bead of plate 9 so as to lie between the inner bead of plate 9 and the inner wall of the skirt of the drive lever ring. Sealing rings 14 may also be disposed around the adjacent upper portion 5 of drive element 3 so as to lie between the inner bead of plate 9 and drive element 3. Alternatively these sealing rings 14 may be disposed on the upper and lower surfaces of the inner bead of plate 9 as shown in FIG. 4. These rings 14 may also be integral with sealing plate 9. In addition, an annular metal piece may be inserted in the inner annular bead of sealing plate 9, to further improve the sealing effect thereof.

As shown in FIG. 5, the inner bead of sealing plate 9 may be integral with the drive lever ring and trimmer drive lever 8, further reducing the number of parts and the manufacturing cost and increasing the sealing effect.

As shown in FIG. 6, the trimmer drive lever 8 may be integral with the annular metal insert further reducing the number of parts and cost and increasing the sealing effect.

As shown in FIG. 7, the connection pin 6 provided at the upper portion drive rod 5 of drive element 3 may be extended and bent at one end, the extended bent end forming a trimmer drive lever 8. The trimmer drive lever 8 so formed is thus distinct from drive element 3 and eliminates the necessity of extending a trimmer drive lever from a drive lever ring or from sealing plate 9. The other end of connecting pin 6 may be inserted in an insertion bore in drive element 3, the insertion bore being formed as an elongate slot or bore of the same cross-section as the unbent portion of connecting pin 6 so that connecting pin 6 is effectively locked in the insertion bore. Sealing plate 9 here is mounted prior to insertion of connecting pin 6 in drive element 3 and the connecting pin 6 is press fitted into drive element 3, thereby making it possible to readily mount sealing plate 9 without fear of damage, thus preventing the deterioration of its sealing effect. The inner bead of plate 9 is fitted into a groove around the lower portion of drive element 3.

Figure 8:
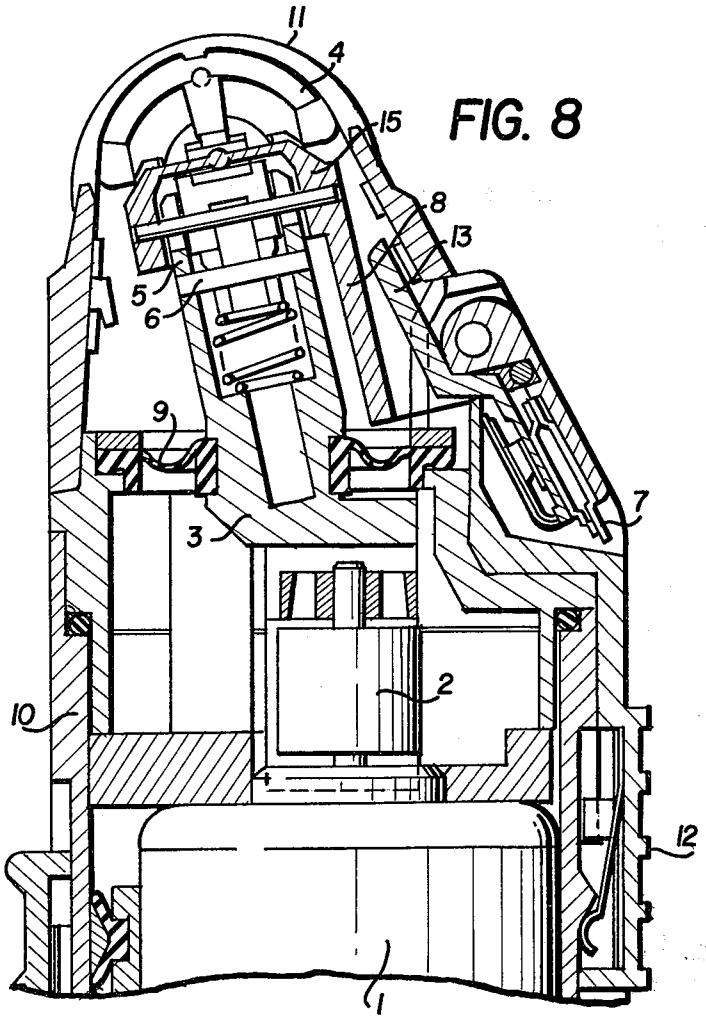
FIG. 8 is a partial side view, in cross-section, of a seventh embodiment of the electric shaver of the claimed invention.

In FIG. 8, the trimmer drive lever 8 is an integral downward extension of the central portion of cutter blade platform 15 (i.e. that portion which is directly above drive element 3). The trimmer drive lever 8 so formed is thus distinct from drive element 3 and eliminates the necessity of extending a trimmer drive lever from a drive lever ring or from sealing plate 9. As in the embodiment of FIG. 8, the inner bead of sealing plate 9 is mounted in a groove around the lower portion of drive element 3, permitting the opening in sealing plate 9 through which drive element 3 projects to be smaller, thereby further preventing deterioration of its sealing effect and facilitating assembly.

Figure 9:
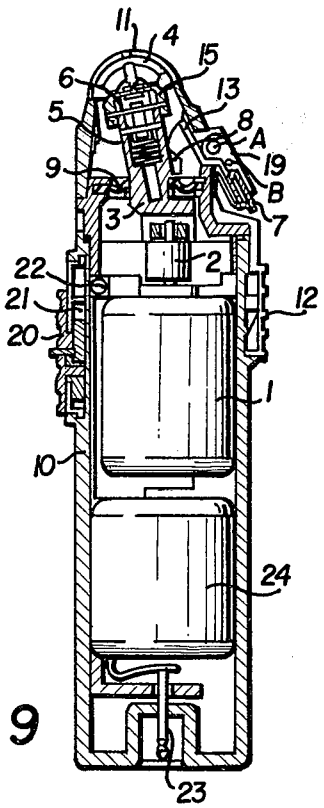
FIG. 9 is a side view, in cross-section, of an eighth embodiment of the electric shaver of the claimed invention.
Figure 10:
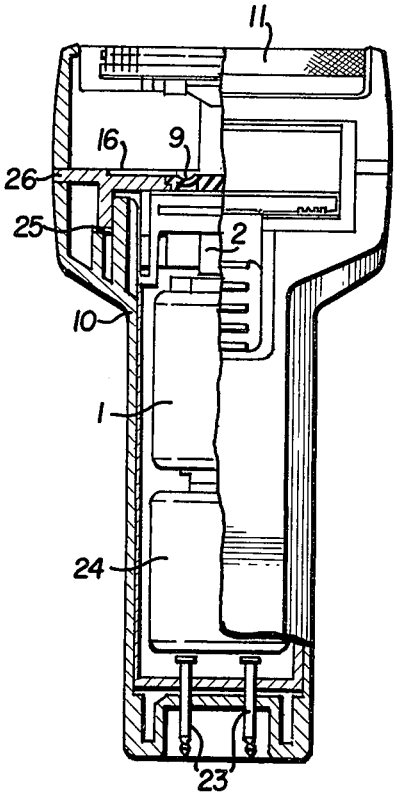
FIG. 10 is a front view, partly in cross-section, of the electric shaver of FIG. 9.
Figure 11:
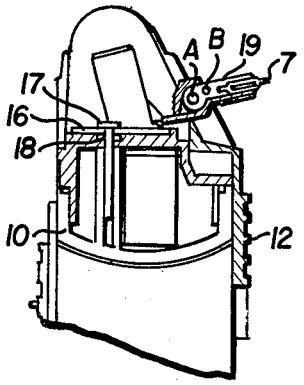
FIG. 11 is a partial side view, in cross-section, of the electric shaver of FIG. 9, showing the trimmer thereof in operating position.
Figure 12:
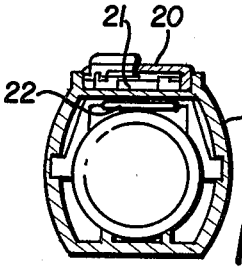
FIG. 12 is an end view, in cross-section, of the electric shaver of FIG. 9, showing an alternative trimmer handle assembly therefor.

Referring to FIG. 9, a metallic retainer plate 16 is provided on the mounting piece 26, as shown in FIG. 10, and has a central opening through which drive element 3 may project. However, the dimensions of the retainer plate opening are such that the retainer plate extends over the inner bead of sealing plate 9 to retain it on mounting piece 26. Screw 17 may be used to fix the retainer plate 16 through O-ring 18 to casing 10 as shown in FIG. 11, thereby further improving the sealing effect. The pivot A of rotation of trimmer 7 is positioned outside and above casing 10 and externally of sealing plate 9. Trimmer 7 is mounted onto a trimmer mounting base and is rotatable about pivot A thereof. A fulcrum B is provided on trimmer blade base 19 of trimmer 7. Fulcrum B is connected to trimmer handle 12 which is slidably mounted on casing 10 so that when trimmer handle 12 is pushed upwardly it raises fulcrum B, thereby rotating trimmer 7 upward and outward as shown in FIG. 11. The interior of casing 10 is separated and sealed from trimmer 7 by sealing plate 9. In the embodiment in FIGS. 9 and 11, the trimmer handle 12 is separate from electrical switch handle 20 which actuates motor 1, but these may alternatively be combined in one assembly. In the latter instance, it is preferable that a magnet 21, as shown in FIG. 12, be provided within switch handle 20 which is incorporated with trimmer handle 12. Magnet 12 acts to actuate a reed switch 22 within casing 10 for motor 1. Trimmer handle 12 is so designed and mounted that when it is pushed up to a first position, reed switch 22 is activated by magnet 21 of switch handle 20 incorporated in trimmer handle 12, but trimmer handle does not engage fulcrum B to project trimmer 7. When the handle 12 is pushed further upward to a second position, reed switch 22 remains on, but trimmer handle engages fulcrum B to project trimmer 7. This may be accomplished by connecting trimmer handle 12 and fulcrum B through a lost-motion slot of appropriate dimensions on trimmer handle 12 or at fulcrum B to delay engagement of these elements until trimmer handle 12 reaches its second position. Switch handle 20 is separate from reed switch 22 and casing 10 is interposed therebetween so that when magnet 21 in switch handle 20 is moved to actuate reed switch 22 and operate motor 1, water-tightness is maintained. Power supply terminals 23 connect to a battery 24 which is connected to motor 1. The power supply terminals 23 are primer-coated on the surfaces with an adhesive or water glass series adhesive of good adhesion to the casing 10, and thereafter the terminals 23 and housing 10 are simultaneously molded to complete the water-sealing. An O-ring 25 for water-sealing is provided between the casing 10 and the support piece 26.

What is claimed is:

1. An electric dry shaver with a trimmer, comprising:

a casing;

a support piece mounted on one end of said casing;

a shaving head enclosure mounted on said support piece, said shaving head enclosure including a perforated shaving comb;

an electric motor disposed within said casing, said motor having a rotatable shaft;

an eccentric cam connected to said rotatable shaft to convert the rotating motion of said shaft to reciprocating motion;

a drive element connected to said eccentric cam, said drive element sharing in the reciprocating motion of said cam, said drive element having a lower portion and an upper portion, said lower portion being that closest to said cam, said upper portion being that furthest from said cam;

a cutter blade platform detachably mounted on said upper portion of said drive element by a connecting pin;

a set of parallel cutter blades mounted on said cutter blade platform, said cutter blades and said cutter blade platform sharing in the reciprocating motion of said drive element so that said cutter blades reciprocate beneath said perforated shaving comb within said shaving head enclosure;

a trimmer mounting base disposed between said support piece and said shaving head enclosure;

a trimmer, one end of said trimmer pivotably mounted on said trimmer mounting base, the other end of said trimmer having trimmer blades;

a trimmer handle slidably mounted on said casing, one end of said handle connected to a fulcrum on said trimmer between said pivot end and said trimmer blade end of said trimmer to rotate said trimmer upward and outward from said trimmer mounting base;

a trimmer drive stem extending from the pivot end of said trimmer;

a flexible sealing plate disposed between said mounting piece and said drive element, said plate having a central opening through which said drive element may project, said plate having an inner annular bead around said opening and an outer bead at the edge of said plate; said inner bead engaging said drive element and sharing in the reciprocating motion of said drive element, said outer bead engaging said mounting piece, whereby said motor is sealed from said perforated shaving comb and said trimmer;

a drive lever ring disposed around said drive element above said plate and sharing in the reciprocating motion of said drive element, said drive lever ring having a trimmer drive lever extending therefrom, said trimmer drive lever being engageable with said trimmer drive stem when said trimmer is rotated upward and outward by said trimmer handle, whereby said trimmer blades share in the reciprocating motion of said drive element.

2. The shaver of claim 1 wherein semi-circular sealing rings are disposed around said drive element between said drive element and said inner bead and around said inner bead between said inner bead and said drive lever ring.

3. The shaver of claim 1 wherein semi-circular sealing rings are disposed on the top and bottom of said inner bead.

4. The shaver of claim 2 or 3 wherein said sealing rings are integral with said inner bead.

5. The shaver of claim 1 wherein an annular metal ring is disposed within said drive lever ring.

6. The shaver of claim 5 wherein said trimmer drive lever is integral with and extends from said annular metal ring portion of said drive lever ring.

7. An electric dry shaver with a trimmer, comprising:

a casing;

a support piece mounted on one end of said casing;

a shaving head enclosure mounted on said support piece, said shaving head enclosure including a perforated shaving comb;

an electric motor disposed within said casing, said motor having a rotatable shaft;

an eccentric cam connected to said rotatable shaft to convert the rotating motion of said shaft to reciprocating motion;

a drive element connected to said eccentric cam, said drive element sharing in the reciprocating motion of said cam, said drive element having a lower portion and an upper portion, said lower portion being that closest to said cam, said upper portion being that furthest from said cam;

a cutter blade platform detachably mounted on said upper portion of said drive element by a connecting pin;

a set of parallel cutter blades mounted on said cutter blade platform, said cutter blades and said cutter blade platform sharing in the reciprocating motion of said drive element so that said cutter blades reciprocate beneath said perforated shaving comb within said shaving head enclosure;

a trimmer mounting base disposed between said support piece and said shaving head enclosure;

a trimmer, one end of said trimmer pivotably mounted on said trimmer mounting base, the other end of said trimmer having trimmer blades;

a trimmer handle slidably mounted on said casing, one end of said handle connected to a fulcrum on said trimmer between said pivot end and said trimmer blade end of said trimmer to rotate said trimmer upward and outward from said trimmer mounting base;

a trimmer drive stem extending from the pivot end of said trimmer;

a flexible sealing plate disposed between said mounting piece and said drive element, said plate having a central opening through which said drive element may project, said plate having an inner annular bead around said opening and an outer bead at the edge of said plate; said inner bead engaging said drive element and sharing in the reciprocating motion of said drive element, said outer bead engaging said mounting piece, whereby said motor is sealed from said perforated shaving comb and said trimmer;

a trimmer drive lever extending from said inner bead, said trimmer drive lever being engageable with said trimmer drive stem when said trimmer is rotated upward and outward by said trimmer handle, whereby said trimmer blades share in the reciprocating motion of said drive element.

8. The shaver of claim 7 wherein semi-circular sealing rings are disposed on the top and bottom of said inner bead.

9. The shaver of claim 7 wherein said sealing rings are integral with said inner bead.

10. The shaver of claim 7 wherein an annular metal ring is disposed within said inner bead.

11. The shaver of claim 10 wherein said trimmer drive lever extends from said annular metal ring portion of said inner bead.

12. An electric dry shaver with a trimmer, comprising:

a casing;

a support piece mounted on one end of said casing; p1 a shaving head enclosure mounted on said support piece, said shaving head enclosure including a perforated shaving comb;

an electric motor disposed within said casing, said motor having a rotatable shaft;

an eccentric cam connected to said rotatable shaft to convert the rotating motion of said shaft to reciprocating motion;

a drive element connected to said eccentric cam, said drive element sharing in the reciprocating motion of said cam, said drive element having a lower portion and an upper portion, said lower portion being that closest to said cam, said upper portion being that furthest from said cam;

a cutter blade platform detachably mounted on said upper portion of said drive element by a connecting pin;

a set of parallel cutter blades mounted on said cutter blade platform, said cutter blades and said cutter blade platform sharing in the reciprocating motion of said drive element so that said cutter blades reciprocate beneath said perforated shaving comb within said shaving head enclosure;

a trimmer mounting base disposed between said support piece and said shaving head enclosure;

a trimmer, one end of said trimmer pivotably mounted on said trimmer mounting base, the other end of said trimmer having trimmer blades;

a trimmer handle slidably mounted on said casing, one end of said handle connected to a fulcrum on said trimmer between said pivot end and said trimmer blade end of said trimmer to rotate said trimmer upward and outward from said trimmer mounting base;

a trimmer drive stem extending from the pivot end of said trimmer;

a flexible sealing plate disposed between said mounting piece and said drive element, said plate having a central opening through which said drive element may project, said plate having an inner annular bead around said opening and an outer bead at the edge of said plate; said inner bead engaging said drive element and sharing in the reciprocating motion of said drive element, said outer bead engaging said mounting piece, whereby said motor is sealed from said perforated shaving comb and said trimmer;

said connecting pin including an extension thereof, said extension being bent downward to from a trimmer drive lever therefrom, said trimmer drive lever being engageable with said trimmer drive stem when said trimmer is rotated upward and outward by said trimmer handle, whereby said trimmer blades share in the reciprocating motion of said drive element.

13. An electric dry shaver with a trimmer, comprising:

a casing;

a support piece mounted on one end of said casing;

a shaving head enclosure mounted on said support piece, said shaving head enclosure including a perforated shaving comb;

an electric motor disposed within said casing, said motor having a rotatable shaft;

an eccentric cam connected to said rotatable shaft to convert the rotating motion of said shaft to reciprocating motion;

a drive element connected to said eccentric cam, said drive element sharing in the reciprocating motion of said cam, said drive element having a lower portion and an upper portion, said lower portion being that closest to said cam, said upper portion being that furthest from said cam;

a cutter blade platform detachably mounted on said upper portion of said drive element by a connecting pin;

a set of parallel cutter blades mounted on said cutter blade platform, said cutter blades and said cutter blade platform sharing in the reciprocating motion of said drive element so that said cutter blades reciprocate beneath said perforated shaving comb within said shaving head enclosure;

a trimmer mounting base disposed between said support piece and said shaving head enclosure;

a trimmer, one end of said trimmer pivotably mounted on said trimmer mounting base, the other end of said trimmer having trimmer blades;

a trimmer handle slidably mounted on said casing, one end of said handle connected to a fulcrum on said trimmer between said pivot end and said trimmer blade end of said trimmer to rotate said trimmer upward and outward from said trimmer mounting base;

a trimmer drive stem extending from the pivot end of said trimmer;

a flexible sealing plate disposed between said mounting piece and said drive element, said plate having a central opening through which said drive element may project, said plate having an inner annular bead around said opening and an outer bead at the edge of said plate; said inner bead engaging said drive element and sharing in the reciprocating motion of said drive element, said outer bead engaging said mounting piece, whereby said motor is sealed from said perforated shaving comb and said trimmer;

a portion of said cutter blade platform extending downward to form a trimmer drive lever, said trimmer drive lever being engageable with said trimmer drive stem when said trimmer is rotated upward and outward by said trimmer handle, whereby said trimmer blades share in the reciprocating motion of said drive element.

14. The shaver of claim 12 or 13 wherein said lower portion of said drive element has a groove around its circumference and said inner bead fits into said groove.

15. The shaver of claims 1, 7, 12 or 13 wherein a retaining plate is mounted on said mounting piece and extends over said outer bead.

16. The shaver of claims 1, 7, 12 or 13 wherein said trimmer handle includes a magnet therein and said motor is operated by a reed switch, said reed switch being enclosed within said casing but actuable by said magnet, said trimmer handle being connected to said fulcrum through a lost-motion slot so as to have a first position in which said magnet actuates said reed switch without rotating said trimmer upward and outward and a second position in which said reed switch remains actuated but said trimmer is rotated upward and outward.

* * * * *